US007194214B2

(12) United States Patent
Takahashi

(10) Patent No.: US 7,194,214 B2
(45) Date of Patent: Mar. 20, 2007

(54) PATCH DENSITY MEASURING APPARATUS AND IMAGE FORMING APPARATUS

(75) Inventor: Osamu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 204 days.

(21) Appl. No.: 11/039,828

(22) Filed: Jan. 24, 2005

(65) Prior Publication Data

US 2005/0163519 A1 Jul. 28, 2005

(30) Foreign Application Priority Data

Jan. 23, 2004 (JP) ..... 2004-015808

(51) Int. Cl.
*G03G 15/00* (2006.01)

(52) U.S. Cl. ..... 399/49; 399/74

(58) Field of Classification Search ..... 399/49, 399/74, 38

See application file for complete search history.

(56) References Cited

U.S. PATENT DOCUMENTS

| | | | | |
|---|---|---|---|---|
| 5,722,007 | A * | 2/1998 | Ogata et al. | 399/49 |
| 5,953,554 | A * | 9/1999 | Ohnishi et al. | 399/49 |
| 6,229,472 | B1 * | 5/2001 | Nishida | 341/161 |
| 6,832,550 | B2 * | 12/2004 | Martin et al. | 101/349.1 |
| 2002/0001479 | A1 * | 1/2002 | Kawai et al. | 399/74 |
| 2005/0041990 | A1 * | 2/2005 | Sugiyama | 399/49 |
| 2006/0245771 | A1 * | 11/2006 | Yamada | 399/38 |

FOREIGN PATENT DOCUMENTS

| | | |
|---|---|---|
| JP | Y2 07-039655 | 9/1995 |
| JP | B2 2625823 | 4/1997 |
| JP | A 09-246970 | 9/1997 |
| JP | B2 3164697 | 3/2001 |
| JP | B2 3272768 | 1/2002 |

* cited by examiner

*Primary Examiner*—Anjan Deb
(74) *Attorney, Agent, or Firm*—Oliff & Berridge, PLC

(57) ABSTRACT

When a regular reflection light receiving unit is receiving a reflected light in a non-image area where the test patches are not formed, a clamp switch is closed. Then, a first reference voltage generated by a pull-up resistor and a zener diode is corresponded to an electric potential of a terminal of a capacitor on the side of an A/D converter. The capacitor is charged by the difference in electric potential between the first reference voltage and an output voltage from the regular reflection light receiving unit. Next, the clamp switch is opened. After the regular reflection light receiving unit receives the reflected light from an image area where the test patches are formed with this state of things, the output voltage from the regular reflection light receiving unit is changed. The difference in density between the image area and the non-image area can be quantified by the A/D converter.

14 Claims, 11 Drawing Sheets

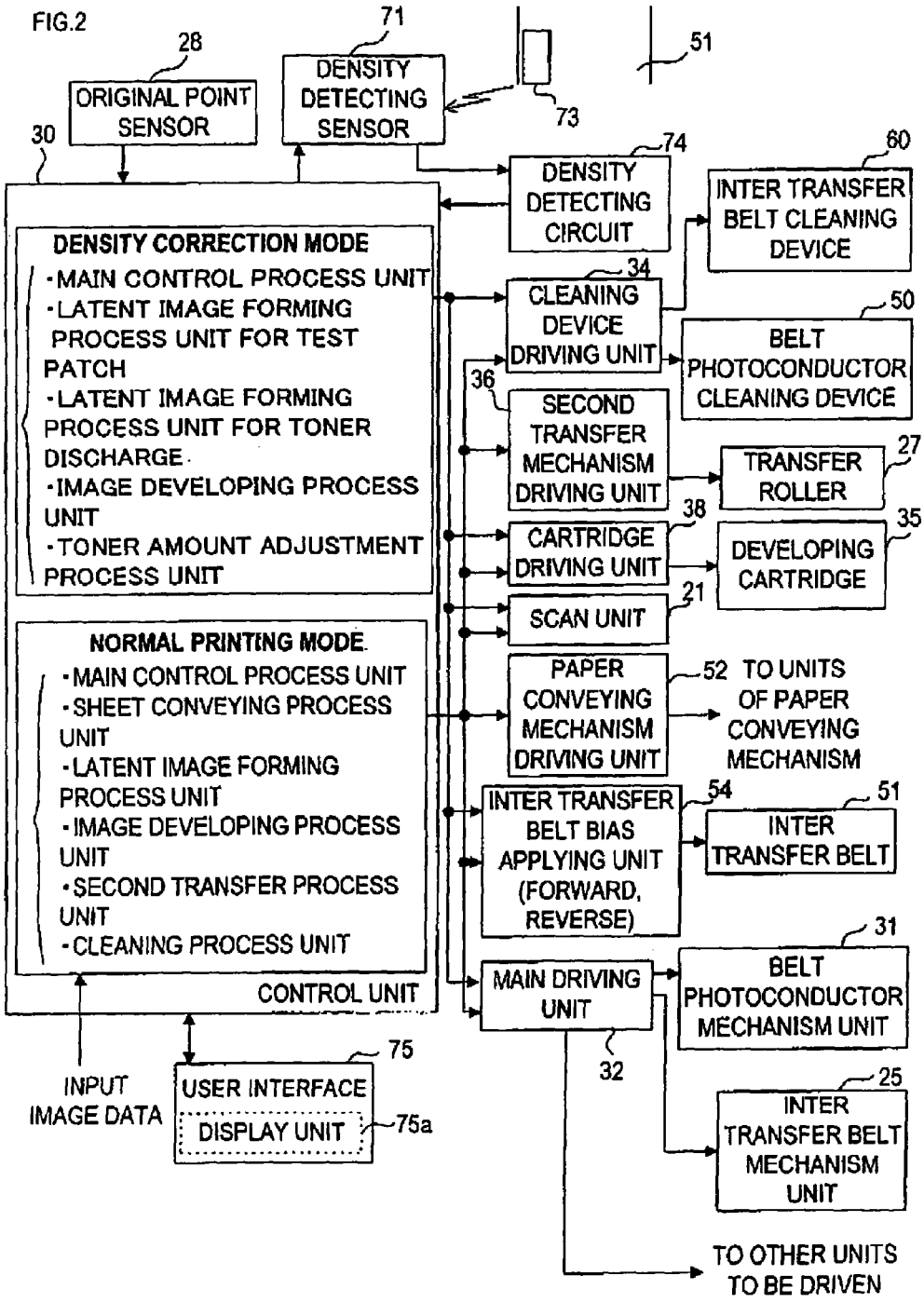
FIG.2
28
ORIGINAL POINT SENSOR
71
DENSITY DETECTING SENSOR
73
51
30
74
DENSITY DETECTING CIRCUIT
60
INTER TRANSFER BELT CLEANING DEVICE
DENSITY CORRECTION MODE
·MAIN CONTROL PROCESS UNIT
·LATENT IMAGE FORMING PROCESS UNIT FOR TEST PATCH
·LATENT IMAGE FORMING PROCESS UNIT FOR TONER DISCHARGE
·IMAGE DEVELOPING PROCESS UNIT
·TONER AMOUNT ADJUSTMENT PROCESS UNIT
34
CLEANING DEVICE DRIVING UNIT
50
BELT PHOTOCONDUCTOR CLEANING DEVICE
36
SECOND TRANSFER MECHANISM DRIVING UNIT
TRANSFER ROLLER
27
38
CARTRIDGE DRIVING UNIT
35
DEVELOPING CARTRIDGE
21
SCAN UNIT
NORMAL PRINTING MODE
·MAIN CONTROL PROCESS UNIT
·SHEET CONVEYING PROCESS UNIT
·LATENT IMAGE FORMING PROCESS UNIT
·IMAGE DEVELOPING PROCESS UNIT
·SECOND TRANSFER PROCESS UNIT
·CLEANING PROCESS UNIT
PAPER CONVEYING MECHANISM DRIVING UNIT
52
TO UNITS OF PAPER CONVEYING MECHANISM
INTER TRANSFER BELT BIAS APPLYING UNIT (FORWARD, REVERSE)
54
51
INTER TRANSFER BELT
31
BELT PHOTOCONDUCTOR MECHANISM UNIT
MAIN DRIVING UNIT
32
CONTROL UNIT
75
INPUT IMAGE DATA
USER INTERFACE
DISPLAY UNIT
75a
25
INTER TRANSFER BELT MECHANISM UNIT
TO OTHER UNITS TO BE DRIVEN

PATCH DENSITY MEASURING APPARATUS AND IMAGE FORMING APPARATUS

BACKGROUND OF THE INVENTION (1) Field of the Invention

The present invention relates to a patch density measuring apparatus which measures the density of patches formed on a transfer medium and an image forming apparatus which has such a patch density measuring apparatus.

(2) Background Art

In order to avoid the density of an image formed by toner from being changed due to a secular change in apparatus and an environmental change, there has been conventionally known an electrostatographic image forming apparatus which has functions to form patches (test pattern), measure the patch density, and correct the density of the image based on the measurement result (for example, see Publication of Japanese Patent No. 3272768).

In a density measuring apparatus provided to the image forming apparatus, when the patch density is measured, the density corresponding to the dirt or scratch of the surface of a transfer medium (base) is measured by a sensor. The sensed voltage signal is converted into digital form by an A/D converter, and stored in a storage device. And then, patches are formed on the transfer medium. The patch density is measured by the sensor. And the analog-digital conversion is performed by the A/D converter. However, when the patch density is measured, the voltage signal stored in the digital form in the storage device upon measuring the surface of the transfer medium is converted into analog form, and is used as a reference voltage for deciding the dynamic range of the A/D convertor. This configuration allows the dynamic range of the A/D converter to be set within a minimal range, so that the accurate density measurement can be achieved.

SUMMARY OF THE INVENTION

However, in the aforementioned density measuring apparatus, since the voltage signal used as the reference voltage upon measuring the patch density is converted into a digital value and stored in the storage device, a D/A converter is required to generate an analog reference voltage. Consequently, the process for measuring the patch density as well as the configuration of the apparatus becomes complicated.

An object of the present invention is to overcome the above described shortcomings of the prior art and to provide a density measuring apparatus that can measure the patch density without complicating the configuration and process.

To attain the above and other objects, there is provided a density measuring apparatus comprising: a light-emitting device that irradiates light to an image area where the image is formed on an image carrying body and a non-image area where the image is not formed, a light receiving device that receives a reflected light of the light irradiated from the light-emitting device to one of the image area and the non-image area and outputs a voltage signal, an A/D converting device that converts the voltage signal from the light receiving device into a digital value using a first reference voltage and a second reference voltage as reference voltages, an electric charge accumulating device disposed on a path from the light receiving device to the A/D converting device, a switch that applies one of the first reference voltage and the second reference voltage to a terminal of the electric charge accumulating device on input side of the A/D converting device, and a switch control device that closes the switch when the reflected light from one of the image area and the non-image area is received by the light receiving device, and opens the switch right before the reflected light from the other of one of the image area and the non-image area is received by the light receiving device. The A/D converting device outputs a voltage signal inputted when the switch is opened as a density measurement value.

In the density measuring apparatus, first, the switch control device closes the switch, when the light receiving device is receiving the reflected light from one of the image area and the non-image area. In this case, the electric potential of the terminal of the electric charge accumulating device on the side of the A/D converting device is one of the first reference voltage and the second reference voltage. Thereby, the electric charge accumulating device is charged by the difference in electric potential between one of the first reference voltage and the second reference voltage and the detected voltage from the light receiving device.

Next, the switch control device opens the switch, right before the light receiving device receives the reflected light from the other of one of the image area and the non-image area. With this state of things, the light receiving device receives the reflected light from the other of one of the image area and the non-image area, the detected voltage from the light receiving device is changed, and the electric potential of the electric charge accumulating device on the side of the A/D converting device is changed according to the changed amount of the detected voltage. The changed amount of the detected voltage depends on the density in the image area with respect to the non-image area. Therefore, the voltage signal that changes in accordance with the density in the image area from one of the first reference voltage and the second reference voltage can be inputted to the AD converting device. The difference in density between the non-image area and the image area can be quantified.

Therefore, according to the configuration as above, without memory for storing the reference voltage, the density can be measured with accuracy.

The light receiving device may detect the regular reflection light and the diffuse reflection light from one of the image area and the non-image area.

By adopting the configuration in which the light receiving device can detect the regular reflection light, the higher the density of the image, the less the amount of the reflected light is. It is useful for density determination particularly of black.

On the other hand, by adopting the configuration in which the light receiving device can detect the diffuse reflection light, the higher the density of the image, the more the amount of the reflected light is. It is useful for density determination except for black.

Alternately, the light receiving device may include a first light receiving device and a second light receiving device. The first light receiving device is disposed so that the regular reflection light from one of the image-area and the non-image area can be detected. The second light receiving device is disposed so that the diffuse reflection light from one of the image area and the non-image area can be detected.

In the density measuring apparatus, regardless of the monochrome image and the color image, the density measurement of the image can be favorably performed.

Furthermore, in the density measuring apparatus including the first light receiving device and the second light receiving device, it is preferable to have a path switch device so as to select which light receiving device should be used.

The light-emitting device does not simultaneously irradiate light to the monochrome image and the color image, and the first light receiving device and the second light receiving device are not simultaneously used. Therefore, when the density of the monochrome image and the color image is measured, the path switch device selects the light-receiving device to be used.

Therefore, in the density measuring apparatus as above, although there are provided two light receiving devices, the other devices can be shared, the configuration can be simplified, and the cost-down can be achieved.

In another aspect of the present invention, there is provided an image forming apparatus comprising: an image forming device that can form patches for density correction on an image carrying body, a density measuring device that measures density of patches formed by the image forming device on the image carrying body, and a density correction device that corrects density of an image when the image forming devices forms the image based on the density of the patches measured by the density measuring apparatus. The image forming apparatus further comprises one of the above described density measuring apparatus.

In the image forming apparatus as above, the density of the image can be measured with accuracy, the density can be corrected. Therefore, the image can be preferably formed.

When the patch density is measured by the image forming apparatus, the amount of the reflected light where the patches are formed and the amount of the reflected light where the patches are not formed should be alternately measured. In this case, the image carrying body and the light receiving device in the density measuring apparatus are relatively moved each other. However, if the image carrying body and the light receiving device can be relatively moved in two directions or more, the configuration and control method become complicated, so that the cost becomes high.

Therefore, it is preferable that a moving device that relatively moves the image carrying body and the light receiving device can be relatively moved in a certain direction. Also, it is preferable that the image forming device alternately forms a patch forming part and a patch non forming part on the image carrying body in one direction.

Therefore, in the image forming apparatus as above, the patch density can be measured just by moving the image carrying body and the light receiving device in one direction. The configuration can be simplified.

Also, in the image forming apparatus as above, it is preferable that a switch control device in the density measuring apparatus controls opening and closing of the switch, each time one of the patch forming part and the patch non forming part passes in accordance with the movement of the image carrying body in relation to the light-emitting device.

In the image forming apparatus as above, the electric charge accumulating device in the density measuring apparatus can be charged each time the density in the image area is measured. Thereby, the electric charge accumulating device is prohibited from being discharged. The accuracy of the density measurement in the patch forming part is improved.

Also, it is preferable that an abnormality detection device is provided. Before the image forming device forms the patches on the image carrying body, the density measuring device measures the density of the image carrying body. If abnormality is detected on the surface of the image carrying body based on the density detection result, the abnormality detection device stops the density measuring device to measure the patch density.

That is, abnormality, such as differences in colors and stains on the surface of the image carrying body, makes the accurate density measurement difficult. If it is determined that the density measurement is not accurately performed, the patch density measurement is stopped.

Therefore, in the image forming apparatus as above, it can avoid the quality of the image from being deteriorated by avoiding the improper density correction.

Furthermore, for example, in case that the image forming apparatus is ink-jet and ink-ribbon image forming apparatus, the image carrying body may be a printing medium such as paper. However, in case that the image forming apparatus is an electrostatographic image forming apparatus, it is preferable that the image carrying body is one of a photoconductor that develops an electrostatic latent image by toner and carries the developed image, a transfer member that carries a transferred image of the developed image, and a sheet conveying belt.

BRIEF DESCRIPTION OF THE DRAWINGS

The present invention will now be described, by way of example, with reference to the accompanying drawings, in which:

FIG. 2 is a schematic block diagram of an electric configuration of the color laser printer;

DETAILED DESCRIPTION OF THE PREFERRED EMBODIMENT

Although the present invention has been described in connection with the above embodiment, the present invention is not limited to the embodiment but may have a various forms.

Figure 1:
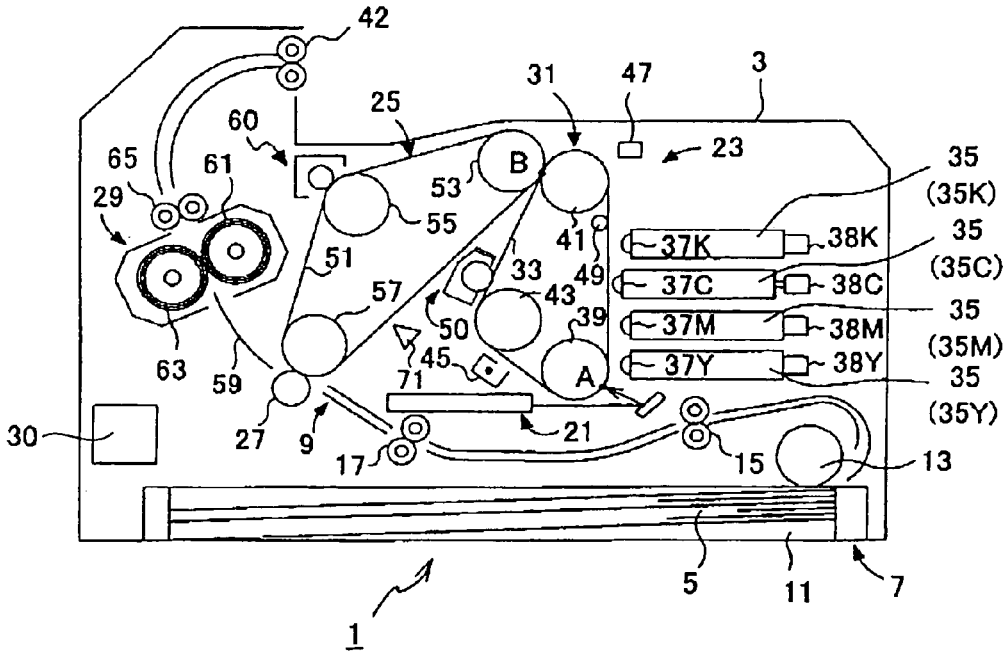
FIG. 1 is a schematic side view of a main part of a color laser printer according to the preferred embodiment of the present invention.

Referring to FIG. 1, the color laser printer 1 takes 4 cycle system. Within a casing main body 3, there are provided a sheet supply unit 7 for supplying a sheet 5, and an image forming unit 9 for forming a certain image on the supplied sheet 5.

The sheet supply unit 7 comprises a sheet supply tray 11, in which the sheet 5 is accommodated in the form of stacked paper, a sheet supply roller 13 which abuts on the sheet 5 positioned on the top of the paper supply tray 11 and picks up one sheet 5 at a time by rotation, conveying rollers 15 which conveys the sheet 5 to an image forming position, and registration rollers 17.

The image forming position indicates a transfer position where a toner image on an inter transfer belt 51 (described hereinafter) is transferred on the sheet 5. In the present embodiment, the image forming position indicates a contact position between the inter transfer belt 51 and a transfer roller 27 (described hereinafter).

The image forming unit 9 comprises a scanner unit 21, a process unit 23, an inter transfer belt mechanism unit 25, a transfer roller 27, and a fixing unit 29, etc.

The scanner unit 21 is located in the center part of the casing main body 3 and provided with a laser emitting unit, a polygon mirror, a plurality of lenses, and reflecting mirrors (not shown). In the scanner unit 21, the laser beam emitted from the laser emitting unit based on an image data is passed or reflected through the polygon mirror, the reflecting mirrors and the lens, and irradiated on the surface of a belt photoconductor 33 (OPC: Organic Photo Conductor) of a belt photoconductor mechanism unit 31 (described hereinafter) with high speed scanning.

The process unit 23 comprises a plurality of (four) developing cartridges 35, and a belt photoconductor mechanism unit 31, etc. The four developing cartridges 35 include a yellow developing cartridge 35Y containing yellow toner, a magenta developing cartridge 35M containing magenta toner, a cyan developing cartridge 35C containing cyan toner, and a black developing cartridge 35K containing black toner. Each of the developing cartridges 35 is located on the front side (right side in FIG. 1) of the casing main body 3, and vertically aligned at a predetermined interval.

Each of the developing cartridges 35 comprises developing rollers 37 (a yellow developing roller 37Y, a magenta developing roller 37M, a cyan developing roller 37C, and a black developing roller 37K), a layer thickness regulating blade, a supply roller, and a toner containing portion (not shown), etc. In order to engage and disengage each of the developing rollers 35 with the surface of a belt photoconductor 33 (described hereinafter), it is configured so that each of the developing cartridges 35 can be moved in a horizontal direction by each of the cartridge driving units 38 (a yellow cartridge driving unit 38Y, magenta cartridge driving unit 38M, a cyan cartridge driving unit 38C, and a black cartridge driving unit 38K).

Each color of the developing rollers 37 comprises a metallic roller shaft, and a roller made of an elastic member such as a conductive rubber material and covering the roller shaft. Specifically, each roller of the developing rollers 37 is formed into two layer structure by an elastic roller part and a coat layer. The elastic roller part is made of conductive polyurethane rubber and silicone rubber, or EPDM rubber including carbon particle. The coat layer covering the surface of the roller part is made of polyurethane rubber, polyurethane resin, and polyimide resin, etc. A predetermined developing bias voltage is applied between the developing roller 87 and the belt photoconductor 33 upon developing the image. A predetermined collecting bias voltage is applied upon collecting the toner. For example, the predetermined developing bias voltage is set at +300V, and the predetermined collecting bias voltage is set at −200V.

In each of the toner containing portions of the developing cartridges 35, a polymerized toner in each color of yellow, magenta, cyan, and black having a spheral and positive electric non-magnetic toner particle is contained. When the image is developed, the toner is supplied to the developing rollers 37 by rotation of the supply roller and is electrostatically positively charged by friction between the supply roller and the developing rollers 37. The toner supplied on the developing rollers 37 is moved between the layer thickness regulating blade and the surface of the developing rollers 37 with rotation of the developing rollers 37, is sufficiently electrostatically charged, and is carried on the developing rollers 37 as a thin layer with a certain thickness. Also, when the toner is collected, a reverse bias is applied to the developing rollers 37. The toner is collected from the belt photoconductor 33 and contained in the toner containing unit.

The belt photoconductor mechanism unit 31 comprises a first belt photoconductor roller 39, a second belt photoconductor roller 41, a third belt photoconductor roller 43, a belt photoconductor 33 wound around the first belt photoconductor roller 39, the second belt photoconductor roller 41, and the third belt photoconductor roller 43, a scorotoron charging unit 45, an electric potential applying unit 47, and an electric potential gradient control unit 49. The configuration of the belt photoconductor mechanism unit 31 will be described hereinafter in more detail.

The inter transfer belt mechanism unit 25 is disposed on the back side of the belt photoconductor mechanism unit 31, and comprises a first inter transfer belt roller 53 disposed approximately opposed to the second belt photoconductor roller 41 via the belt photo conductor 33 and an inter transfer belt (ITB: Inter Transfer Belt) 51 (described hereinafter), a second intermediate transfer belt roller 55 disposed diagonally back down the first inter transfer belt roller 53, a third inter transfer belt roller 57 disposed opposed to a transfer roller 27 (described hereinafter) via the inter transfer belt 51, and an inter transfer belt 51 wound around the circumference from the first inter transfer belt roller 53 to the third inter transfer belt roller 57.

The inter transfer belt 51 is formed as an endless belt made of conductive resin such as polycarbonate and polyimide distributing conductive particles such as carbon.

The first inter transfer belt roller 53, the second transfer belt roller 55, and the third inter transfer belt roller 57 are arranged in a triangular form, and the inter transfer belt 51 is wound therearound. The first inter transfer bolt roller 53 is rotated and activated via a drive gear (not shown) by the drive of a main motor (not shown). The second inter transfer belt roller 55 and the third inter transfer belt roller 57 are driven. Thereby, the inter transfer belt 51 is moved around from the first inter transfer belt roller 53 to the third inter transfer belt roller 57 (in a clockwise direction).

A density detecting sensor 71 for detecting the density of each color on the inter transfer belt 51 is provided between the first inter transfer belt roller 53 and the third transfer belt roller 57 and facing the inter transfer belt 51. The density detecting sensor 71 comprises a light source for emitting light in an infrared region (a light-emitting diode 80, refer to FIG. 3), and a light receiving unit 81 for receiving the reflected light (refer to FIG. 3), etc.

The transfer roller 27 is disposed opposed to the third inter transfer belt roller 57 of the inter transfer belt mechanism unit 25 via the inter transfer belt 51. The transfer roller 27 comprises a metallic roller shaft and a roller made of a conductive rubber material covering the roller shaft, and is rotatably supported. By transfer roller approach/separation mechanisms (not shown), the transfer roller 27 can be moved to a stand-by position to separate from the inter transfer belt 51, and to a transferable position to approach or abut the inter transfer belt 51. The transfer roller approach/ separation mechanisms are disposed facing each other on both sides in the width direction of the sheet 5 across a transfer path 59 of the sheet 5, and press the sheet 5, passing through the transfer path 59, against the inter transfer belt 51 at the transferable position.

In the printing process, while the visible image for each color is subsequently transferred onto the inter transfer belt 51, the transfer roller 27 is positioned at the stand-by position. When all the visible images are transferred from the belt photoconductor 33 to the inter transfer belt 51 and the color image is formed on the inter transfer belt 51, the transfer roller 27 is positioned at the transferable position. In the density correction process (refer to FIG. 7), the transfer roller 27 is controlled to be positioned at the stand-by position.

A transfer bias is applied to the transfer roller 27 by an inter transfer belt bias applying unit 54. Thereby, a predetermined transfer bias is applied to the inter transfer belt 51 at the transferable position.

The fixing unit 29 is disposed backward the inter transfer belt mechanism unit 25, and comprises a heating roller 61, a pressure roller 63 for pressing the heating roller 61, a pair of conveying rollers 65 provided downstream of the heating roller 61 and the pressure roller 63. The heating roller 61 comprises a halogen lamp for heating. The outer layer of the heating roller is made of silicone rubber, and the internal layer of the heating roller is made of metal.

Next, the belt photoconductor mechanism unit 31 of the image forming unit 9 will be described.

The first belt photoconductor roller 39 is disposed backward and facing the four developing cartridges 35, and is disposed more downstream than the yellow developing cartridge 35Y that is located at the lowest position. The first belt photoconductor roller 39 is a driven roller.

The second bolt photoconductor roller 41 is disposed vertically up the first belt photoconductor roller 39 and upper than the black developing cartridge 35K located at the highest position. The second belt photoconductor roller 41 is rotated and driven by the drive of a main motor (not shown) via a driving gear (not shown).

The third belt photoconductor roller 39 is disposed diagonally back up the first belt photoconductor roller 39. The third belt photoconductor roller 43 is a driven roller.

Thus, the first belt photoconductor roller 39, the second belt photoconductor roller 41, and the third belt photoconductor roller 43 are arranged in a triangular form.

The second belt photoconductor roller 41 is applied with +800 volts from the electric potential applying unit 47 disposed adjacent thereto with the use of a power source of the scorotoron charging unit 45.

The first belt photoconductor roller 39 and the third belt photoconductor roller 43 are made of conductive members such as aluminum, contacted with a base material layer (described hereinafter) of the belt photoconductor 33, and connected with a GND terminal (not shown). That is, the first belt photoconductor roller 39 and the third belt photoconductor roller 43 maintain the electric potential of the belt photoconductor 33 at GND in their contacted portions.

The belt photoconductor 33 is wound around the first belt photoconductor roller 39, the second belt photoconductor roller 41, and the third belt photoconductor roller 43. While the second belt photoconductor roller 41 is rotated, the first belt photoconductor roller 39 and the third belt photoconductor roller 43 are driven accordingly. Thereby, the belt photoconductor 33 is moved around (in a counter clockwise direction).

The belt photoconductor 33 is an endless belt having a base material layer whose thickness is 0.08 mm on one side, and a photosensitive layer whose thickness is 25 μm on the other side. The base material layer is made of a nickel conductive material formed by the nickel electroforming process. The photosensitive layer is made of a photo conductor of polyearbonate resin.

The scorotoron charging unit 45 is disposed facing the belt photoconductor 33 with a predetermined interval so that the scorotoron charging unit 45 is not in contact with the belt photoconductor 33 at the position below the belt photoconductor mechanism unit 31, upstream of an exposed portion to the belt photoconductor 33 by a scan unit 21, and adjacent to the first belt photoconductor roller 39. The scorotoron charging unit 45 is a scorotoron-type charging unit for positive charging, which generates a corona discharge from a charging wire such as tungsten and positively charges the surface of the belt photoconductor 33 uniformly.

The electric potential gradient control unit 49 is located between the second belt photoconductor roller 41 and the first belt photoconductor roller 89, and contacted with the base material layer of the belt photoconductor 33 at the position upstream of the black developing cartridge 35K. The electric potential gradient control unit 49 sets the electric potential of the base material layer to GND in the contacted part.

Next, an electric configuration of the color laser printer 1 will be described with reference to FIG. 2. Also, each of the processes to the point where a color image is formed on the sheet 5 in a normal printing mode due to cooperation within the aforementioned apparatus will be described. FIG. 2 is a schematic block diagram of the electric configuration of the color laser printer 1.

As illustrated in FIG. 2, the color laser printer 1 comprises a control unit 30 (built-in CPU, ROM, and RAM, etc) for controlling each unit of the printer 1. In the control unit 30, the image forming operation is performed in the normal printing mode, and the correction operation of the toner density is performed in a toner density correction mode.

In the normal printing mode, the control unit 30 of the color laser printer 1 initializes each unit of the printer 1 to be controlled during the image formation using a main control process unit (program), provides a control signal to a main driving unit 32, drives a motor of the main driving unit 32 to operate the belt photoconductor mechanism unit 31 and the inter transfer belt mechanism unit 25, and moves the belt photoconductor 33 in a circumferential direction.

Also, the control unit 30 operates the scorotoron charging unit 45 so as to positively uniformly charge the belt photoconductor 33 before the electrostatic latent image is formed. Simultaneously, the control unit 30 provides the control signal based on an input image data from a latent image forming process unit (program) to the scan unit 21 at a predetermined timing based on the information regarding an original point (marker) detected by an original point sensor 28, and operates the scan unit 21.

That is, in the color laser printer 1, due to such operations by the control unit 30, the laser beam is irradiated from the scan unit 21 to the surface of the positively charged belt photoconductor 33 at an exposed point A shown in FIG. 1. The electric potential of the surface of the belt photoconductor 33 is changed from the state right after the belt photoconductor 33 is charged. Thereby, the electrostatic latent image based on the input image data is formed on the surface of the belt photoconductor 3*a*. Also, in the color laser printer 1, the thus formed electrostatic latent image is conveyed from the exposed point A toward the developing cartridges 35 located downstream of the rotating direction of the belt photoconductor 33 by rotation of the belt photoconductor 33.

Furthermore, the control unit 30 inputs a control signal to an inter transfer belt bias applying unit 37 so as to apply the forward bias to the inter transfer belt 51 for transferring the toner image on the belt photoconductor 33 from the belt photoconductor 33 to the inter transfer belt 51.

The control unit 30 operates the cartridge driving units 38 at a predetermined timing before the electrostatic latent image reaches the developing cartridges 35 by an image developing process unit (program) to move a certain developing cartridge 35 forward the belt photoconductor 33.

That is, a control signal is inputted to the cartridge driving units 38. Developing cartridge driving mechanisms of the driving cartridges 35 are driven by the cartridge driving units 38. And the developing roller 37 of a certain developing cartridge 35 is contacted with the belt photo conductor 33. Thereby, the electrostatic latent image is developed by the toner supplied from the developing rollers 37 in contact with the belt photoconductor 33 when passing through the developing cartridges 35. The toner image as the visible image is formed on the surface of the belt photoconductor 33.

In the color laser printer 1, after the toner image is formed, by rotation of the belt photoconductor 33, the toner image is conveyed to a primary transfer point B (i.e. the contact position between the inter transfer belt 51 and the belt photoconductor 33) located downstream of the developing point of the developing cartridges 35. At the primary transfer point B, the toner image is transferred onto the surface of the inter transfer belt 51.

In the color laser printer 1, a series of operations from the formation process of the electrostatic latent image to the primary transfer process is performed for every toner in each color. The formed toner image in each color is subsequently superimposed on the inter transfer belt 51 during the primary transfer process. Consequently, the multicolor toner image, made by the super imposition of the toner image in each color, is formed on the surface of the inter transfer belt 51.

Specifically, in the color laser printer 1, by the operation by the control unit 30, the electrostatic latent image for cyan is formed on the belt photoconductor 33 based on the multicolor input image data. The cyan developing cartridge 35C is moved forward in the horizontal direction by the developing cartridge driving mechanism. The developing roller 37C of the cyan developing cartridge 35C is contacted with the belt photoconductor 33. And, the developing rollers 37 of the magenta developing cartridge 35M, the yellow developing cartridge 35Y, and the black developing cartridge 35K are separated from the belt photoconductor 33.

Thereby, in the color laser printer 1, the electrostatic latent image for cyan is firstly developed by the cyan toner to form the cyan toner image. Furthermore, the cyan toner image is primarily transferred onto the surface of the inter transfer belt 51 at the contact position (primary transfer point B) between the inter transfer belt 51 and the belt photoconductor 33.

Afterwards, in the color laser printer 1, a cleaning device driving unit 34 is controlled by a cleaning process unit (program) of the control unit 30. A belt photoconductor cleaning device 50 (described hereinafter), fixed and located downstream of the primary transfer point B in the moving direction of the belt photoconductor 33, is operated. The toner image after the primary transfer (i.e. the residual toner remaining on the surface of the belt photoconductor 33 after the primary transfer) is removed from the belt photoconductor 33. The surface of the belt photoconductor 33 is cleaned.

Subsequently, in the color laser printer 1, after the belt photoconductor 33 is repeatedly charged by the scorotoron charging unit 45, the electrostatic latent image for magenta is formed on the belt photoconductor 33 by the latent image forming process unit of the control unit 30. Only the developing roller 37 of the magenta developing cartridge 35M is contacted with the belt photoconductor 33 by the cartridge driving unit 38 controlled by the image developing process unit of the control unit 30. The other developing cartridges 35Y, 35C, and 35K are separated. The electrostatic latent image for magenta is developed by the magenta toner. The magenta toner image, formed on the surface of the belt photoconductor 33 by the development, is superimposed on the cyan toner image, formed on the surface of the inter transfer belt 51 by the previous operation, and transferred.

In the color laser printer 1, in order to thus superimpose the toner image and perform the primary transfer, the scan unit 21 is driven at a predetermined interval in accordance with the rotation period of the inter transfer belt 51 by the latent image forming process unit so as to form the electrostatic latent image on the belt photoconductor 33. Also, in the color laser printer 1, the same operation as described above is performed with respect to yellow and black, so that the multicolor toner image, consisted of cyan (C), magenta (M), yellow (Y), and black (BK), is formed on the surface of the inter transfer belt 51.

Afterwards, in the color laser printer 1, the control signal is inputted from a second transfer process unit (program) of the control unit 30 to a second transfer mechanism driving unit 36. The second transfer mechanism driving unit 36 is operated. The transfer roller 27, located downstream of the primary transfer point B in the moving direction of the inter transfer belt 51, is contacted with the inter transfer belt 51.

In the color laser printer 1, by the operation of a paper conveying mechanism driving unit 52 controlled by a sheet conveying process unit (program), the sheet 5 conveyed from the sheet supply tray 11 is inserted between the transfer roller 27 and the inter transfer belt 51 in accordance with the passage of the multicolor toner image. The multicolor toner image is transferred (the second transfer) from the inter transfer belt 51 to the sheet 5, and the multicolor image is formed on the surface of the sheet 5.

In the color laser printer 1, upon completion of the second transfer, the sheet is conveyed to the fixing unit 29. The color image is fixed on the sheet 5 by the fixing unit 29. The sheet 5 after the fixing process is conveyed to the pair of discharge rollers 42 by the convey roller 15, and is discharged onto a discharge tray, formed in the upper part of the casing main body 3, by the discharge rollers 42. Simultaneously, in the control unit 30 of the color laser printer 1, an inter transfer belt cleaning device (described hereinafter) is operated by the cleaning process unit. The residual toner remaining on the inter transfer belt 51 after the second transfer is removed. The inter transfer belt 51 is cleaned.

Thus, the color image is formed on the sheet 5. When the density correction mode is performed, test patches 73 are formed on the inter transfer belt 51. The density of the test patches 73 is read by the density detecting sensor 71 as illustrated in FIGS. 1 and 2. Specifically, the density detecting sensor 71 converts the density of the test patch 73 formed on the inter transfer belt 51 into the analog voltage value, and outputs the voltage value. The output from the density detecting sensor 71 is converted into digital form by the density detecting circuit 74, and is inputted to the control unit 30.

The control unit 30 determines whether or not the toner density of each color is precisely reproduced based on the toner density supplied by each of the developing cartridges 35C, 35M, 35Y, and 35K. If it is determined that the toner density of each color has not been precisely reproduced, the toner amount to be provided to the belt photoconductor 33 is corrected.

Figure 3:
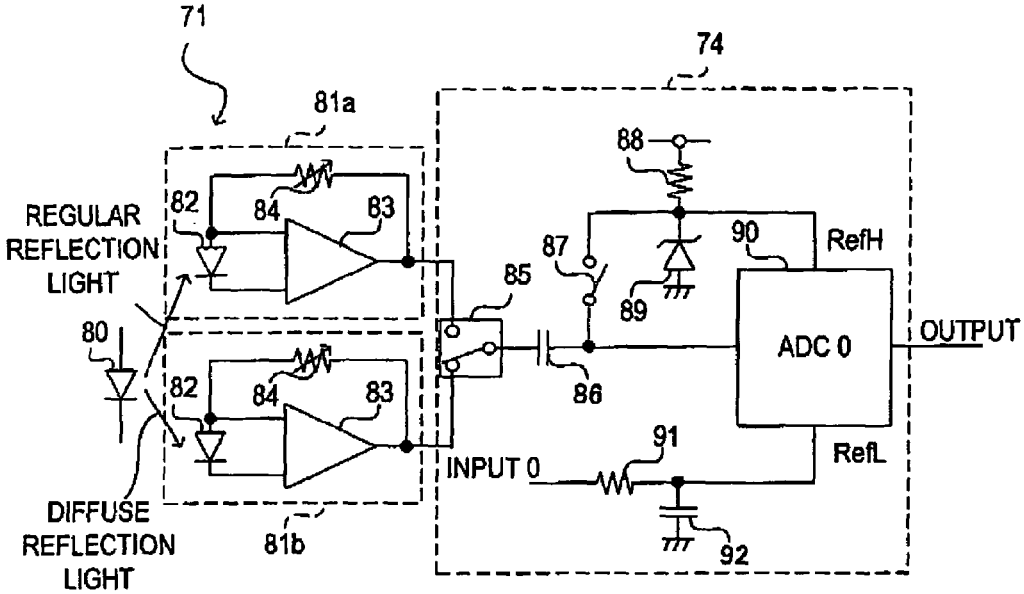
FIG. 3 is a specific circuit diagram of a density detecting sensor and a density detecting circuit.

The density detecting sensor 71 and a density detecting circuit 74 are configured as illustrated in FIG. 3.

As described above, the density detecting sensor 71 comprises the light-emitting diode 80 for emitting light in the infrared region and the light receiving unit 81 for receiving the reflected light. As illustrated in FIG. 3, the light receiving unit 81 comprises a regular reflection light receiving unit 81*a* for receiving the light irradiated from the light-emitting diode 80 and regularly reflected by the inter transfer belt 51 or the test patch 73, and a diffuse reflection light receiving unit 81*b* for receiving the light diffusely reflected by the inter transfer belt 51 or the test patches 73.

The light receiving unit 81 comprises a photo diode 82 for receiving the light from the light-emitting diode 80 to convert the light into the electric charge, a comparison amplifier 83 for amplifying the electric charge generated from the photo diode 82, and a variable resistor 84 for varying the amplification factor of the comparison amplifier 83.

Due to this configuration, the light, received by each of the light receiving units 81, is converted into the electric charge by the photo diode 82, is amplified to a predetermined electric potential by the comparison amplifier 83, and is provided to the density detecting circuit 74. In the present embodiment, the regular reflection light receiving unit 81*a* is used for detecting the density of the black toner. The diffuse reflection light receiving unit 81*b* is used for detecting the density of the toner except black (i.e., the toner of yellow, cyan, and magenta).

Next, the density detecting circuit 74 comprises: an A/D converter 90 for receiving the output from each of the light receiving units 81 of the density detecting sensor 71 to convert into digital value, and outputting the digital value; a path selection switch 85 for selecting one of the output from the light receiving units to input to the A/D converter 90; and a capacitor 86 disposed on the path from the path selection switch 85 to the A/D converter 90.

The reference voltage for defining the dynamic range used for the A/D conversion should be inputted to the A/D converter 90.

Therefore, the density detecting circuit 74 comprises a circuit for generating a first reference voltage to be the reference voltage (RefH) of the high electric potential. That is, a pull-up resistor 88 connected to the power source is serially connected with a zener diode 89 connected to the ground. At the connecting point between the pull-up resistor 88 and the zener diode 89, the first reference voltage of the constant voltage is generated and inputted as the reference voltage of the high electric potential.

The reference voltage of the low electric potential (Ref L: a second reference voltage) in the A/D converter 90 is generated, for example, by smoothing an input waveform (input 0) inputted as a wave pulse. That is, in the density detecting circuit 74, a smoothing resistor 91 and a smoothing capacitor 92 are arranged on the reference voltage input side of the low electric potential in the A/D converter 90. The input wave form is smoothed by the smoothing resistor 91 and the smoothing capacitor 92. The second reference voltage is generated as the constant voltage.

Only one zener diode 89 is illustrated in FIG. 3. However, a plurality of zener diodes 89 may be serially connected according to the electric potential of the first reference voltage to be generated.

A clamp switch 87 is disposed at the position between a certain point on the input path, from the capacitor 86 to the A/D convertor 90, and the connecting point between the pull-up resistor 88 and the zener diode 89.

In the clamp switch 87 and the path selection switch 85, opening and closing of the connecting point and switching are performed by the control unit 30. The timing will be described hereinafter.

In the control unit 30, the value, immediately after the status, in which the clamp switch 87 is closed, is changed to the status, in which the clamp switch 87 is opened, and the input voltage of the A/D converter 90 is changed, is stored as a density value for each test patch 73.

Figure 4:
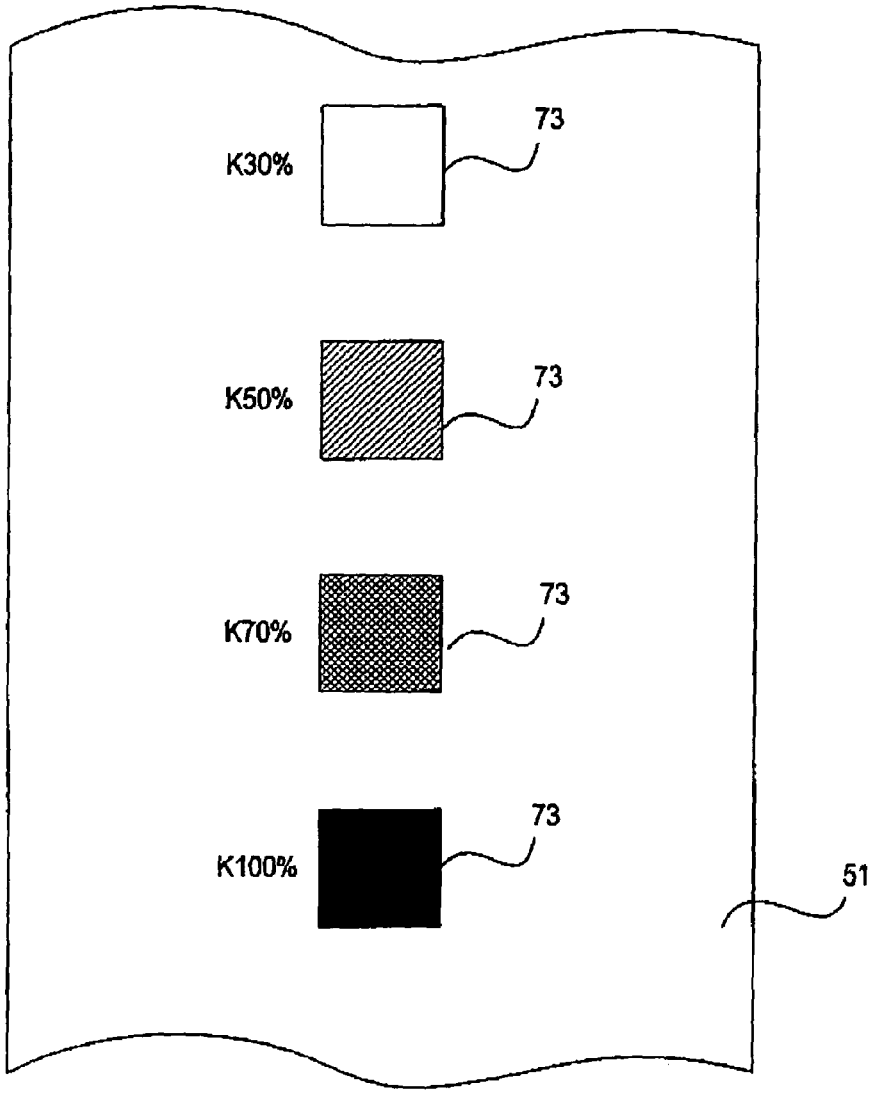
FIG. 4 is a specific explanatory view of test patches.

Next, the operating status of the density detecting circuit 74, when the density detecting circuit 74 reads the density of the test patches 73, will be described with reference to FIGS. 4 to 6.

First, in the color laser printer 1, the test patches 73, whose density is measured by the density detecting sensor 71, are formed on the inter transfer belt 51. In this case, the test patches 73 are disposed along the conveying direction of the inter transfer belt 51 as illustrated in FIG. 4. Basically, the test patches 73 are disposed at regular intervals. For example, the size and interval of the test patch is 3 cm each. However, in a belt surface state detection process as described hereinafter (refer to FIG. 8), the test patches 73 are not formed in a case where abnormality is detected on the surface of the inter transfer belt 51. Therefore, the test patches 73 may not be disposed at regular intervals. However, the interval of each test patch 73 is set not to be shorter than the predetermined intervals (3 cm in the present embodiment).

Figure 5:
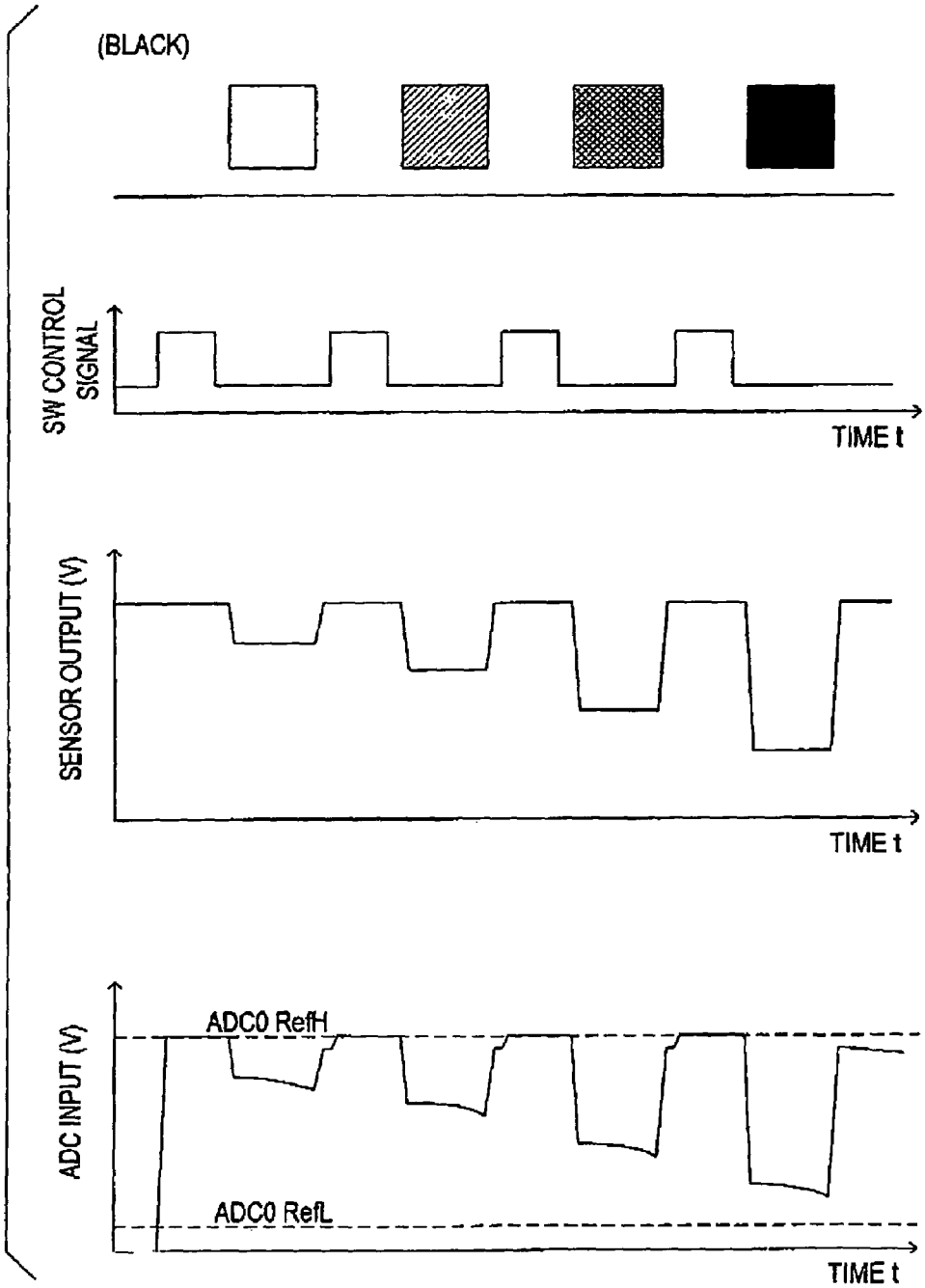
FIG. 5 is a timing chart showing an output voltage of a regular reflection light receiving unit and an input voltage of an A/D converter, upon measuring density of black toner.

When the density of the test patch 73 formed by the black toner is measured, a toner amount adjustment process unit (program) of the control unit 30 switches the path selection switch 85 to the side of the regular reflection light receiving unit 81*a*, and transmits a switch (SW) control signal shown in FIG. 5 to the clamp switch 87 to control the opening and closing of the clamp switch 87. When the switch control signal is at high level, the clamp switch 87 is closed. When the switch control signal is at low level, the clamp switch 87 is opened.

As illustrated in FIG. 5, the output (sensor output) from the regular reflection light receiving unit 81*a* is largest, when the density in a non-image area, where the test patch 73 is not formed, is detected. The higher the density of the test patch 73, the smaller the output is. The output from the regular reflection light receiving unit 81*a* is not affected by the SW control signal.

The input voltage (ADC input) to the A/D converter 90 is largely affected by the SW control signal. That is, when the regular reflection light receiving unit 81*a* receives the reflection light in the non-image area where the test patch 73 is not formed, the control unit 30 sets the SW control signal at high level and closes the clamp switch 87. Then, the electric potential of the terminal of the capacitor 86 on the side of the A/D converter 90 is equal to the first reference voltage generated by the pull-up resistor 88 and the zener diode 89. The capacitor 86 is charged by the difference in electric potential between the first reference voltage and the output voltage from the regular reflection light receiving unit 81*a*.

The control unit 30 sets the SW control signal at low level right before the regular reflection light receiving unit 81*a* receives the reflection light from the test patches 73, and opens the clamp switch 87. In this state of things, the reflection light from the test patch 73 is received by the regular reflection light receiving unit 81*a*. The output voltage from the regular reflection light receiving unit 81*a* is changed (decreased). The electric potential of the capacitor 86 on the side of the A/D converter 90 is changed (decreased) according to the changed amount. The changed amount of the output voltage from the regular reflection light receiving unit 81*a* depends on the density in the image area (where test patches 73 are formed) with respect to the non-image area. Therefore, the voltage signal that changes in accordance with the density in the image area from the first reference voltage can be inputted to the A/D converter 90. The difference in density between the non-image area and the image area can be quantified.

Every time the density of the test patches 73 is measured in the non-image area positioned between the test patches 73, the control unit 30 is configured to set the SW control signal at high level so that the capacitor 86 is repeatedly charged. This configuration prohibits the capacitor 86 from being discharged.

Figure 6:
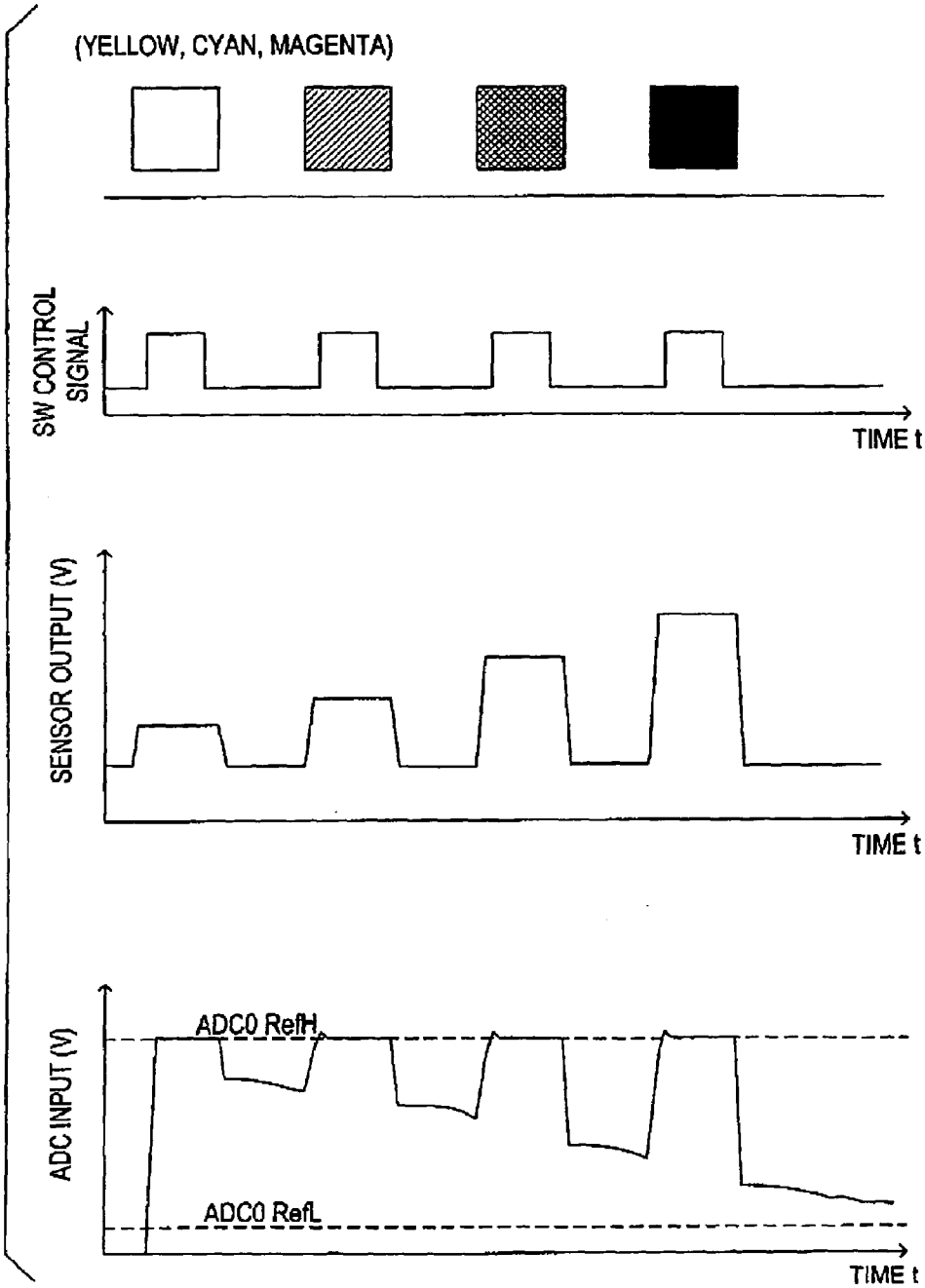
FIG. 6 is a timing chart showing an output voltage of a diffuse reflection light receiving unit and an input voltage of an A/D converter, upon measuring density of toner except black.

In the same way as the density of the test patches 73 formed by the black toner is measured, when the density of the test patches 73 formed by the toner except black is measured, the toner amount adjustment process unit of the control unit 30 switches the path selection switch 85 to the side of the diffuse reflection light receiving unit 81*b*, transmits the switch control signal as illustrated in FIG. 6 to the clamp switch 87 so as to control the opening and closing of the clamp switch 87.

The output (sensor output) from the diffuse reflection light receiving unit 81*b* is smallest, when the density in the non-image area is detected. The higher the density of the test patches 73, the larger the output is. That is, the output characteristic from the diffuse reflection light receiving unit 81*b* is opposite to the output characteristic from the regular reflection light receiving unit 81*a*.

Therefore, the control unit 30 is configured to set the SW control signal at high level in the image area so that the input voltage (ADC input) inputted to the A/D converter 90 obtains the same waveform (i.e., the configuration, in which the higher the density of the test patch 73, the lower the input voltage is) as when the density of the test patches 73 formed by the black toner is measured.

Therefore, in the same way as when the density of the test patches 73 formed by the black toner is measured, when the density of the test patches 73 formed by the toner except black is measured, the density of the test patches 73 can be measured.

The input wave (input 0) for defining the reference voltage on the side of the low electric potential in the A/D converter 90 is changed to the predetermined value by the toner colors of the detected test patches 73. Specifically, the duty ratio of the input wave is changed by the toner color, so that the reference voltage on the side of the low electric potential in the A/D converter 90 is changed accordingly.

Thus, the dynamic range of the A/D converter 90 can be appropriately set in accordance with the toner color.

Next, a series of the processes for correcting the density will be described with reference to FIGS. 7 and 8.

The control unit 30 performs the density correction process, for example, when the apparatus (the color laser printer 1) is turned on, the number of printings reaches 1000, and 6 hours are passed after the previous process in the normal printing mode. After the density correction process is performed, first in S110, the belt surface state detection process is performed.

Figure 8:
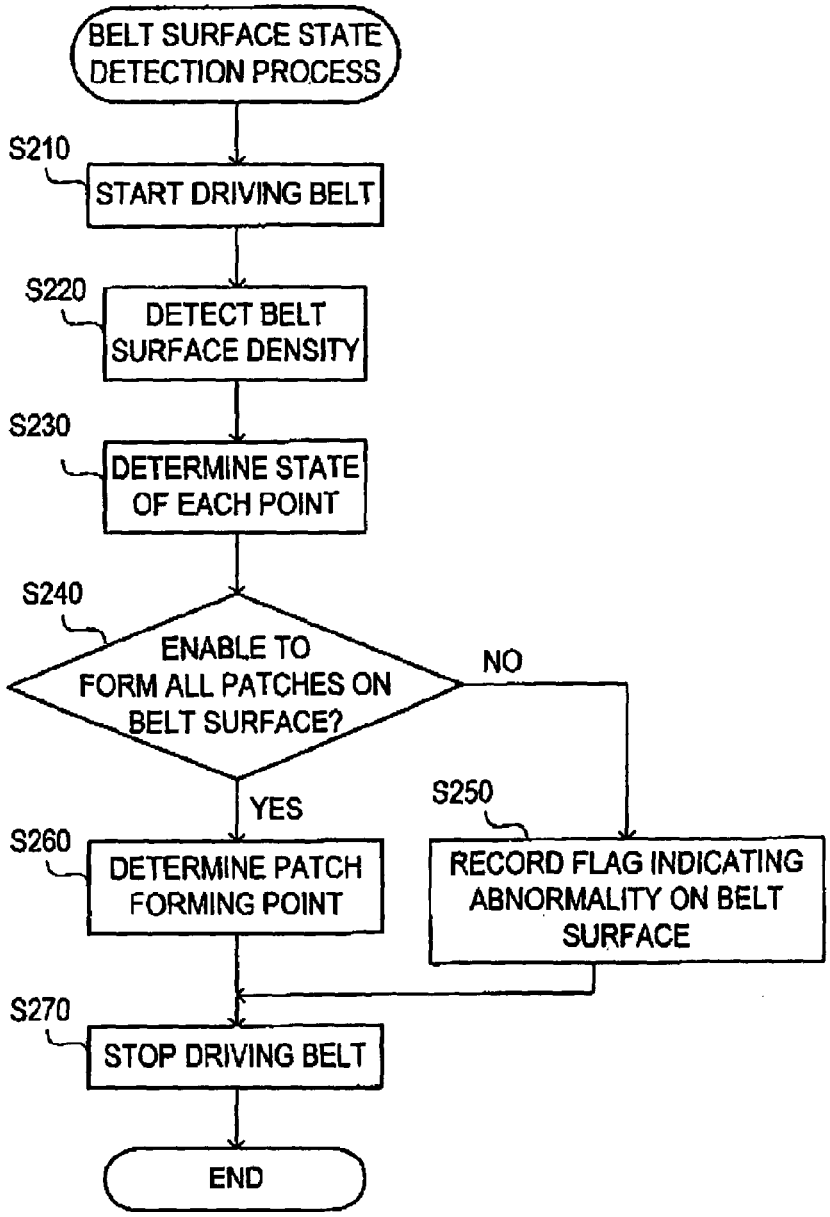
FIG. 8 is a flow chart of a belt surface state detection process in the density correction process.

In the belt surface state detection process, as illustrated in FIG. 8, the drive of the belt photoconductor 33 and the inter transfer belt 51 is started in S210.

The procedure moves to S220. The density of the surface of the inter transfer belt 51, where the test patches 73 are formed, is measured at every regular interval. And, the density at every measuring point is stored in the control unit 30 as the difference from the average value of the previously measured density. The regular interval is half (3 cm) of the intervals (6 cm in the present embodiment) for forming the test patches 73.

Next, the procedure moves to S230. It is determined whether the point where the density is measured is a normal point located within a predetermined tolerance level, or is an abnormal point located over the predetermined tolerance level. Abnormality means a stain and/or damage of the inter transfer belt 51.

The procedure moves to S240. It is determined whether or not the number of the two consecutive normal points is larger than the number of the test patches 73 to be formed. That is, as described hereinafter, when the test patches 73 are formed, the area, where the test patches 73 are formed, and the area, where the test patches 73 are not formed, are alternately disposed at regular intervals. As described above, the density detecting sensor 71 detects the density difference between the image area and the non-image area. Therefore, in order to precisely measure the density of the test patches 73, at least two consecutive normal points are required. Furthermore, in order to consecutively measure the density, a plurality of the test patches 73 are required to be disposed. Therefore, at least two consecutive normal points are required to the number of the test patches 73. That is why the process of S240 is performed.

In S240, when it is determined the number of two consecutive normal points is equal to or larger than the number of the test patches 73 to be formed, the procedure moves to S260. The position where the test patches 73 are formed is determined. The procedure moves to S270.

On the other hand, when it is determined the number of two consecutive normal points is smaller than the number of the test patches 73 to be formed, the procedure moves to S250. A flag that indicates abnormality on the surface of the inter transfer belt 51 is recorded in the control unit 30. The procedure moves to S270.

In S270, the drive of the belt photoconductor 33 and the inter transfer belt 51 are stopped to terminate the belt surface state detection process.

Figure 7:
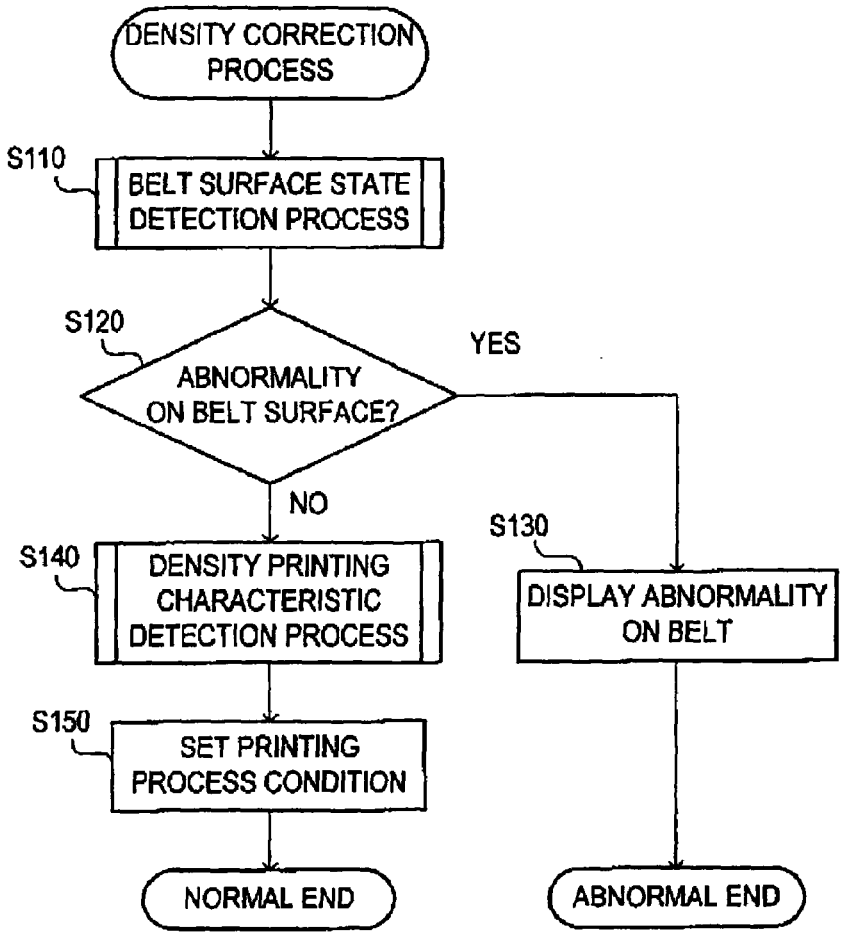
FIG. 7 is a flow chart of a density correction process executed by a control unit.

Next, the procedure moves to S120 in the density correction process in FIG. 7. Whether the flag that indicates abnormality on the inter transfer belt 51 is recorded or not is determined. When it is determined that the flag has been recorded, the procedure moves to S130. Indication about the abnormality on the inter transfer belt 51 is displayed on a display unit 75*a* to terminate the density correction process.

On the other hand, in S120, when it is determined that the flag that indicates abnormality on the inter transfer belt 51 has not been recorded, the procedure moves to S140.

Figure 9:
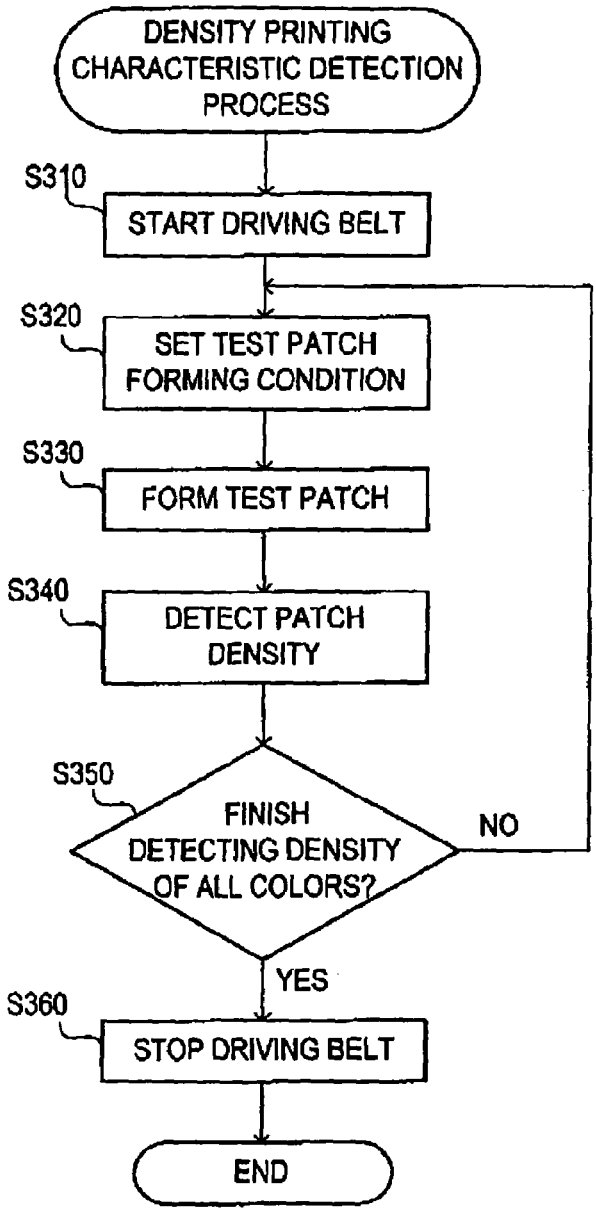
FIG. 9 is a flow chart of a density printing characteristic detection process in the density correction process.

In S140, the density printing characteristic detection process is performed. As illustrated in FIG. 9, in the density printing characteristic detection process, first in S310, the drive of the belt photoconductor 33 and the inter transfer belt 51 is started.

The procedure moves to S320 so as to set conditions for forming the test patches 73 (the colors for forming the test patches 73, and the forming positions of the test patches 73, etc).

The procedure moves to S330. The one of the developing cartridges 35 is selected for the test patch density determination. With the toner within the developing cartridges 35, the test patches 73 are formed.

Specifically, in the control unit 30, as described above, the surface of the belt photoconductor 33 is charged. The control signal for forming the electrostatic latent image for the test patch is inputted from the latent image forming process unit for the test patch (program) to the scan unit 21. Thereby, the electrostatic latent image for the test patch is formed on the surface of the belt photoconductor 33. Simultaneously, the selected developing cartridge 35 is moved so that the developing roller 37 is contacted with the belt photoconductor 33. When the electrostatic latent image is passed, the electrostatic late image is developed with the toner supplied from the developing roller 37 so as to form the test patches 73.

The procedure moves to S340. The density of the test patches 73 transferred on the inter transfer belt 51 is optically detected when the test patches 73 are passed through the position opposed to the density detection sensor 71. The detection result (detected density value De) is obtained.

After the detected density value De is obtained, the control unit 30 obtains a reference density value Ds with respect to the same toner as the test patches 73, and an acceptance value M. Based on the values Ds, M, and the detected density value De, the density correction value with respect to the color forming the test patches 73 is calculated and stored in the control unit 30. And, the test patches 73 are cleared.

The procedure moves to S350. Whether or not the density correction is performed with respect to the developing cartridges 35 of all four colors. When it is determined that the density correction has not been performed with respect to all colors, the procedure returns to S320. When it is determined that the density correction has been performed with respect to all colors, the procedure moves to S360. The drive of the belt photoconductor 33 and the inter transfer belt 51 is stopped to terminate the density printing characteristic detection process.

The procedure moves to S150 in the density correction process in FIG. 7. A printing process condition is set based on the density correction value recorded in S340 so as to terminate the density correction process.

Due to the above described configuration, the voltage signal that changes in accordance with the density in the image area can be inputted from the first reference voltage or the second reference voltage to the A/D converter 90. Therefore, a memory to store the reference voltage is not required, and the density can be measured with accuracy.

The regular reflection light receiving unit 81*a* is provided. Thereby, it can be configured so that the higher the density of the test patches 73, the less the amount of the reflected light is. The density determination of black, particularly whose brightness is low, can be performed with accuracy.

The diffuse reflection light receiving unit 81*b* is provided. Thereby, it can be configured so that the higher the density of the test patches 73, the more the amount of the reflected light is. The density determination of other colors than black, particularly whose brightness is high, can be performed with accuracy.

Therefore, in the color laser printer 1 comprising the regular reflection light receiving unit 81*a* and the diffuse reflection light receiving unit 81*b*, the density measurement of the test patches 73 can be favorably performed regardless of the monochrome image and the color image.

Furthermore, the path selection switch 85 is provided so as to switch which light receiving unit 81 is used. Thereby, although there are provided two light receiving units 81, the other components such as the A/D converter 90, can be shared. Therefore, the configuration can be simplified, and the cost-down can be achieved.

In the color laser printer 1 of the present embodiment, since the light-emitting diode 80 does not simultaneously irradiate light to the monochrome image and the color image, the regular reflection light receiving unit 81*a* and the diffuse reflection light receiving unit 81*b* are not simultaneously used. Therefore, the cost-down can be achieved without deteriorating the performance.

The light-emitting diode 80 alternately irradiates light to the image area and the non-image area. Every time the light-emitting diode 80 irradiates light to the image area or the non-image area, the control unit 30 controls the opening and closing of the clamp switch 87. Consequently, every time the density in the image area is measured, the capacitor 86 can be charged and prohibited from being discharged. Therefore, the density measurement accuracy in the image area can be improved. Furthermore, the density can be corrected, and the preferable image can be formed.

Also, the control unit 30 alternately forms the image area, where the test patches 73 are formed, and the non-image area, where the patches are not formed. Therefore, the patch density can be measured by moving the inter transfer belt 51 and the light receiving unit 81 in one direction. And the configuration can be simplified.

The control unit 30 measures the density of the inter transfer belt 51 before forming the patches on the inter transfer belt 51. When abnormality is detected on the surface of the inter transfer belt 51, an error is reported to the user. Therefore, it can prevent the quality of the image from being deteriorated by preventing the improper density correction.

Also, the control unit 30 forms the test patches 73 on the inter transfer belt 51 in the color laser printer 1 to measure the density. Therefore, the density of the test patches 73 can be measured without wasting a printing medium such as a recording paper.

Compared to the case in which the image is formed on the printing medium, it is unlikely to be influenced by the outside light. Therefore, the measurement condition can be stabilized, and the measurement accuracy of the density of the test patches 73 can be improved.

Figure 10A:
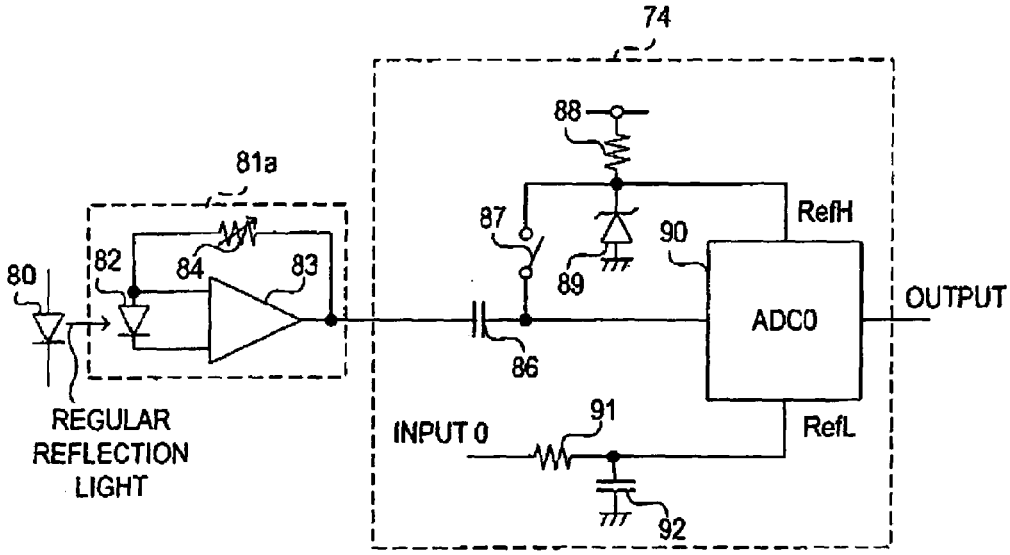
FIGS. 10A and 10B are specific circuit diagrams of the density detecting sensor and the density detecting circuit in an modified embodiment.

In the present embodiment, two light receiving units 81 are provided. The light receiving unit 81 to be used is selected by the path selection switch 85. Thereby, the density of the test patches 73 formed by the black toner and the toner except black can be detected by the single density detecting circuit 74. However, it is not limited to the configuration as this. For example, as illustrated in FIG. 10, a density detecting circuit 74*a* (FIG. 10A) for measuring the density of the test patches 73 formed by the black toner, and a density detecting circuit 74*b* (FIG. 10B) for measuring the density of the test patches 73 formed by the toner except black may be provided.

Figure 10B:
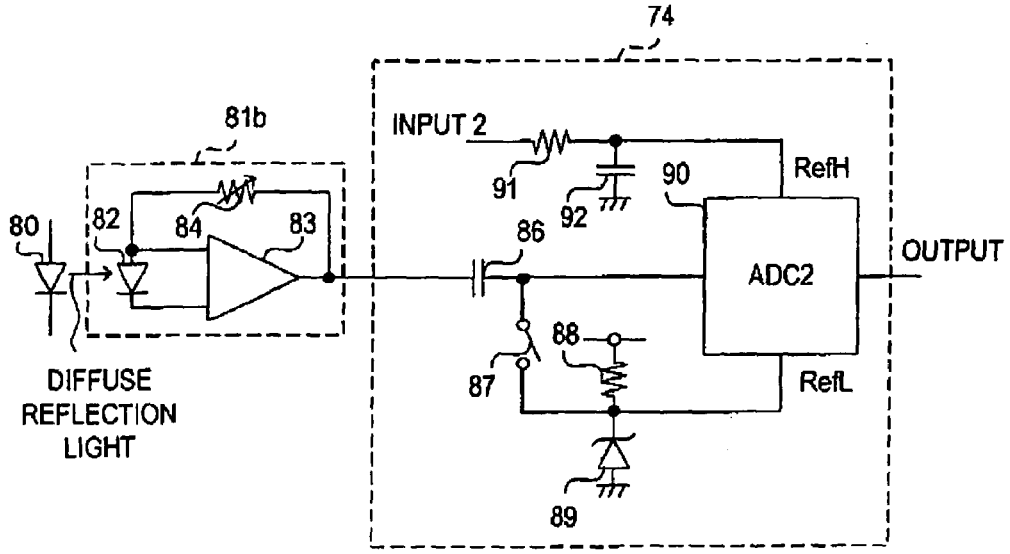

Also, it may be configured so that the terminal for inputting the reference voltage of the A/D converter on the side of the low electric potential and the high electric potential is reversed as the density detecting circuit 74*b* for measuring the density of the test patches 73 formed by the toner except black as illustrated in FIG. 10B.

Figure 11:
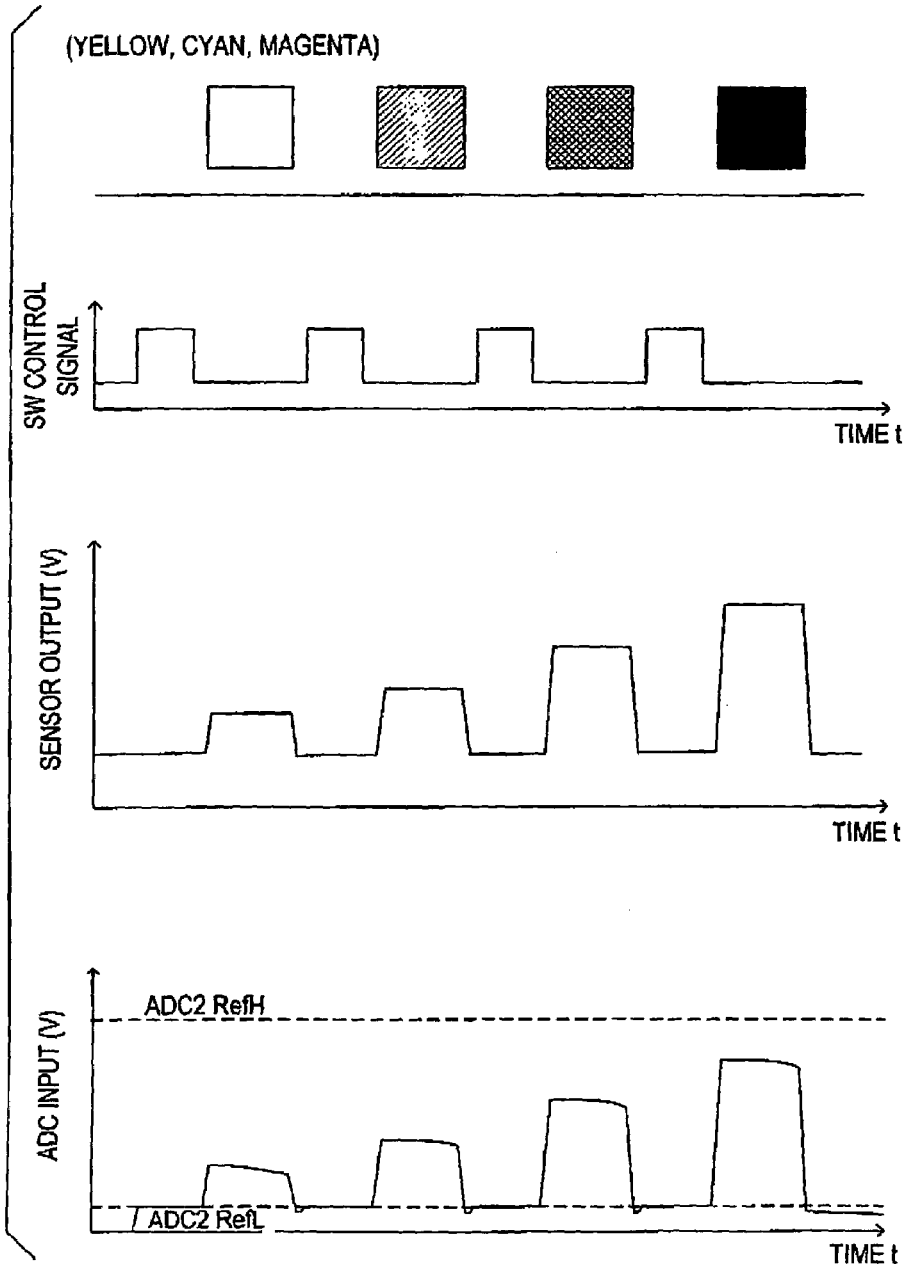
FIG. 11 is a timing chart showing the output voltage of the diffuse reflection light receiving unit and the input voltage of the A/D converter, upon measuring the density of the toner except black in a modified embodiment.

In this case, as illustrated in FIG. 11, when the regular reflection light receiving unit 81*a* is receiving the reflected light in the non-image area, the control unit 30 can set the SW control signal at high level and close the clamp switch 87. Right before the regular reflection light receiving unit 81*a* receives the reflected light from the test patches 73, the control unit 30 can set the SW control signal at high level and open the clamp switch 87.

By doing this, the input voltage of the A/D converter (ADC input) is increased in accordance with the density in the image area where the test patches 73 are formed from the second reference voltage (Ref L). That is, the output at the time of detecting the density in the non-image area is smallest. The higher the density of the test patches 73, the larger the output is.

Therefore, the density of the test patches 73 can be favorably measured as in the above described color laser printer 1 even by this configuration.

Also, in the present embodiment, the present invention is applied to the electrostatographic color laser printer 1. However, the present invention may be applied to the ink-jet, and ink-ribbon image forming apparatus. In this case, the test patches 73 are formed on the printing medium such as the recording paper, and the density is measured.

In the present embodiment, the test patches 73 are formed on the inter transfer belt 51, and the density is measured. For example, the test patches 73 may be formed on the photoconductor or the photoconductor belt that develops the electrostatic latent image by the toner and carries the developing image, the transfer member that carries the transferred image of the developing image, and the sheet conveying belt, and the density may be measured.

The light-emitting diode 80 may irradiate the light that transmits the deflector lens to the test patches 73. Furthermore, each of the light receiving units 81 may receive the reflected light that transmits the polarized lens. In this case, when the light deflected to be a vertically polarized wave is irradiated in the non-image area, the reflected light becomes only the vertically polarized wave. When the light is irradiated in the image area, the reflected light becomes the light mixing the vertically polarized wave and the horizontally polarized wave. Therefore, the light receiving units 81 of the reflected light may receive the reflected light transmitting the polarized lens. By detecting at least one of the vertically polarized wave and the horizontally polarized wave, the density of the test patches 73 can be favorably measured.

What is claimed is:

1. A density measuring apparatus that measures density of an image formed on an image carrying body, comprising:

a light-emitting device that irradiates light to an image area where the image is formed on the image carrying body and a non-image area where the image is not formed;

at least one light receiving device that receives a reflected light of the light irradiated from the light-emitting device to one of the image area and the non-image area and outputs a voltage signal;

an A/D converting device that converts the voltage signal from the light receiving devices into a digital value using first reference voltage and a second reference voltage as reference voltages;

an electric charge accumulating device disposed on a path from the light receiving devices to the A/D converting device;

a switch that applies one of the first reference voltage and the second reference voltage to a terminal of the electric charge accumulating device on input side of the A/D converting device; and a switch control device that closes the switch when the reflected light from one of the image area and the non-image area is received by the light receiving devices, and opens the switch right before the reflected light from the other of one of the image area and the non-image area is received by the light receiving devices, wherein the A/D converting device outputs a digital voltage signal, which is a measure of the density, the digital voltage signal being output when a signal is input when the switch is opened.

2. The density measuring apparatus according to claim 1, wherein the light receiving device is disposed so that a regular reflection light from one of the image area and the non-image area can be detected.

3. The density measuring apparatus according to claim 1, wherein the light receiving device is disposed so that a diffuse reflection light from one of the image area and the non-image area can be detected.

4. The density measuring apparatus according to claim 1, wherein a plurality of light receiving devices are further provided, and the light receiving devices include a first light receiving device and a second light receiving device, the first light receiving device being disposed so that a regular reflection light from one of the image-area and the non-image area can be detected, the second light receiving device being disposed so that a diffuse reflection light from one of the image area and the non-image area can be detected.

5. The density measuring apparatus according to claim 4, wherein a path switch device is further provided to select one of the first light receiving device and the second light receiving device in the light receiving units to be used.

6. An image forming apparatus, comprising:

an image forming device that forms patches for density correction on an image carrying body as one of images;

a density measuring device that measures density of the patches on the image carrying body; and a density correction device that corrects density of an image when the image forming devices forms the image based on the density of the patches measured by the density measuring device, wherein the density measuring device comprises:

a light-emitting device that irradiates light to an image area where the image is formed on the image carrying body and a non-image area where the image is not formed;

at least one light receiving device that receives a reflected light of the light irradiated from the light-emitting device to one of the image area and the non-image area and outputs a voltage signal;

an A/D converting device that converts the voltage signal from the light receiving devices into a digital value using first reference voltage and a second reference voltage as reference voltages;

an electric charge accumulating device disposed on a path from the light receiving devices to the A/D converting device;

a switch that applies one of the first reference voltage and the second reference voltage to a terminal of the electric charge accumulating device on input side of the A/D converting device; and a switch control device that closes the switch when the reflected light from one of the image area and the non-image area is received by the light receiving devices, and opens the switch right before the reflected light from the other of one of the image area and the non-image area is received by the light receiving devices, wherein the A/D converting device outputs a digital voltage signal, which is a measure of the density, the digital voltage signal being output when a signal is input when the switch is opened.

7. The image forming apparatus according to claim 6, wherein the light receiving device is disposed so that a regular reflection light from one of the image area and the non-image area can be detected.

8. The image forming apparatus according to claim 6, wherein the light receiving device is disposed so that a diffuse reflection light from one of the image area and the non-image area can be detected.

9. The image forming apparatus according to claim 6, wherein a plurality of light receiving devices are further provided, and the light receiving devices include a first light receiving device and a second light receiving device, the first light receiving device being disposed so that a regular reflection light from one of the image-area and the non-image area can be detected, the second light receiving device being disposed so that a diffuse reflection light from one of the image area and the non-image area can be detected.

10. The image forming apparatus according to claim 6, wherein a path switch device is further provided to select one of the first light receiving device and the second light receiving device in the light receiving units to be used.

11. The image forming apparatus according to claim 6, wherein a moving device that relatively moves the image carrying body in relation to the light receiving devices of the density measuring device in a certain direction is provided, and the image forming device alternately forms a patch forming part where the patches are formed and a patch non forming part where the patches are not formed on the image carrying body in the direction in which the image carrying body is moved by the moving device.

12. The image forming apparatus according to claim 11, wherein the switch control device in the density measuring apparatus controls opening and closing of the switch each time one of the patch forming part and the patch non forming part passes in accordance with the movement of the image carrying body in relation to the light-emitting device.

13. The image forming apparatus according to claim 6, wherein before the image forming device forms the patches on the image carrying body, the density measuring device measures the density of the image carrying body, and in case that abnormality is detected on a surface of the image carrying body based on the density detected result, an abnormality detection device stops the density measuring device to measure the density of the patches.

14. The image forming apparatus according to claim 6, wherein the image forming apparatus is an electrostatographic image forming apparatus, and wherein the image carrying body is one of a photoconductor that develops an electrostatic latent image by toner and carries the developed image, a transfer member that carries a transferred image of the developed image, and a sheet conveying belt.

* * * * *